United States Patent [19]

Hsieh et al.

[11] Patent Number: 4,872,796

[45] Date of Patent: Oct. 10, 1989

[54] COMPOUND DEVICE FOR PUNCHING AND BINDING

[76] Inventors: Kun-Chih Hsieh; Jien-Hung Chow; Hsin-Chien Chen, all of P.O. Box 10780, Taipei 10099, Taiwan

[21] Appl. No.: 208,162

[22] Filed: Jun. 17, 1988

[51] Int. Cl.[4] ..... B42L 19/12

[52] U.S. Cl. ..... 412/16; 412/40

[58] Field of Search ..... 281/21.1; 412/16, 40

[56] References Cited

U.S. PATENT DOCUMENTS

| | | | |
|---|---|---|---|
| 4,008,501 | 2/1977 | Cutler | 412/40 X |
| 4,613,266 | 9/1986 | Scharer | 412/40 |
| 4,645,399 | 2/1987 | Scharer | 412/16 |

*Primary Examiner*—Paul A. Bell

[57] ABSTRACT

A main shaft in this device may rotate reciprocatingly within a certain angle to make a row of punch blades up and down reciprocatingly, of which one end is set pivotally inside one end of an aligned manual shaft which is bearing a winding handle on the other end. And, both shafts may rotate separately or synchronously by removing/inserting a pin from/into the coaxial dual shaft. i.e., the main shaft can be driven by either electric motor or manpower to have the papers punched. The manual shaft is always driven by manpower to have the bindings opened so as to bind paper. This device has a margin guiding member to fix the papers in position before punching, and also has a binding size indicating member to quickly indicate the proper size/number of bindings being needed.

5 Claims, 7 Drawing Sheets

COMPOUND DEVICE FOR PUNCHING AND BINDING

BACKGROUND OF THE INVENTION

This invention reveals a device to combine operations of punching and binding for papers.

To punch row holes on papers and to bind them together conveniently are important processes in handling document in the office.

Primarily punching and binding operations had to be done on two individual devices—punch machine and binding machine.

Afterward, there came a compound device by applying a dual-purpose shaft driven by a manual handle which can be pushed forward for punch purpose and pulled backward for binding purpose. But still it needed a pretty great manpower to punch a thick wad of papers. The prior art as shown in FIG. 10.

Later, it came a motor—driven punch machine equipped with a motor as the power source. But the binding device can not be mounted on such punch machine because of its imperfect design and construction.

Regarding the devices measuring the thickness of papers and indicating the needed binding number/size simultaniously, those used in the past are to set the papers upright, so as to lean against the horizontal rule scale set on the base to read its thickness or to read the right size/number of binding. Apparently, it is awkward and unreliable.

As for the device in setting margin while punching holes the traditional devices have only one way by moving the unrotatable margin quider to get any revisions of margin. Evidently, it is inconveinent and inefficient.

SUMMARY OF THE INVENTION

One object of this invention is to provide a compound device to fulfill paper punching, either by electric power or manpower, and fulfill bindings on the same unit.

Another object of this invention is to offer a punching device which can be driven by either electric motor or manpower without changing the parts but merely increasing or removing a few parts. i.e., most of the parts of the parts of both types can be substituted each other and produced together. Naturally, cost of either type can be substantially reduced then. Especially, their constructions are simple and of similar size to the traditional ones.

Another object of this invention is to offer a indicating device which is composed of slide indicator connected to spring so as to quickly and accurately measure the thickness of papers ready for binding and furthermore, to indicate the needed size/number of binding simultaneously.

Another object of this invention is to offer a margin guiding device which has a movable and rotatable guider block in order to set margins for the papers at two fixed measurements quickly and accurately by turning this guider block by 90 degrees, either clockwise or counterclockwise, while papers are set for punching.

BRIEF DESCRIPTION OF THE DRAWINGS

The attached drawings will be helpful in explaining the constructions and functions of this invention.

DETAILED DESCRIPTION OF THE INVENTION

Figure 1:
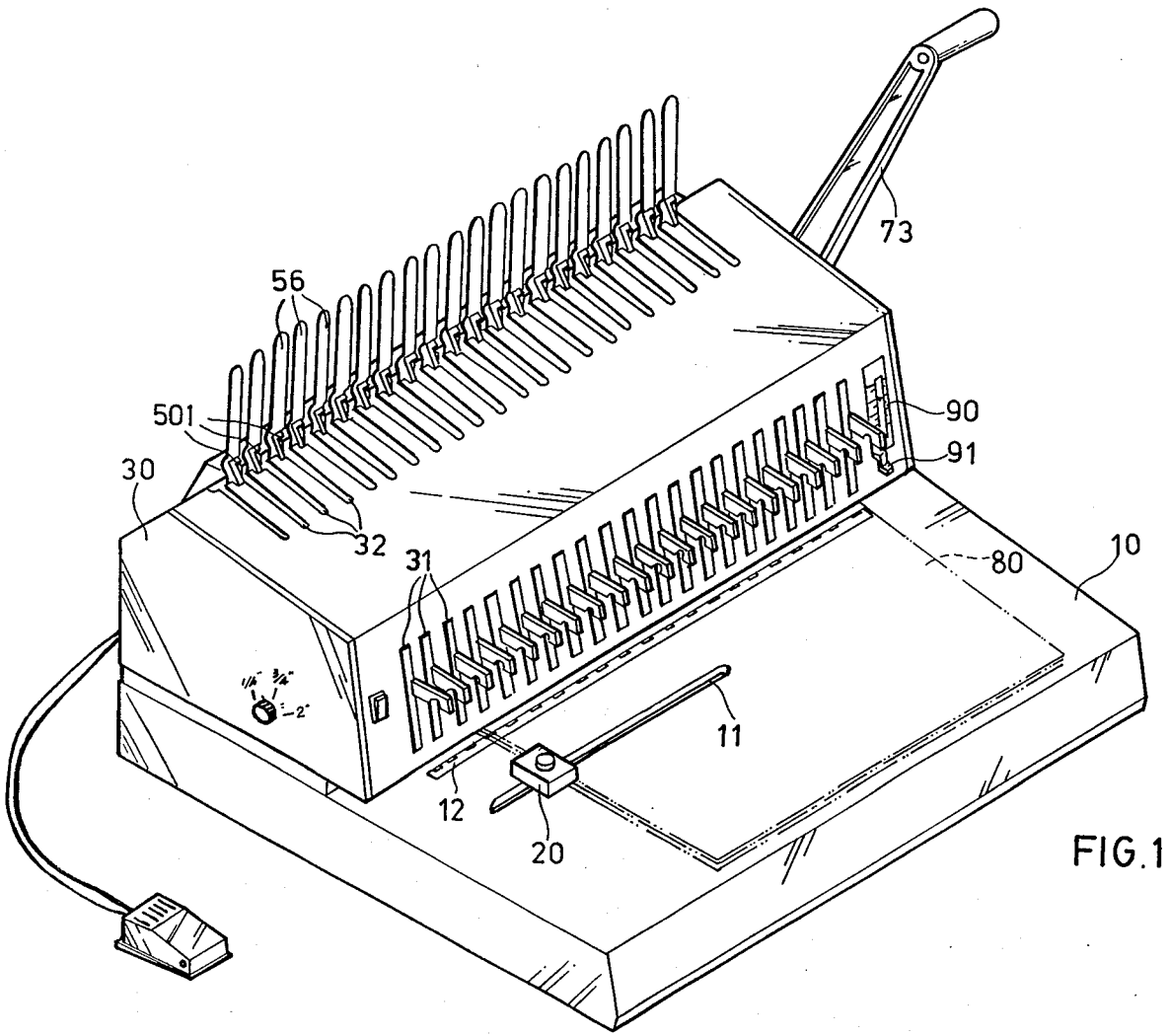
FIG. 1 is the front perspective view of an embodiment of this invention.
Figure 2:
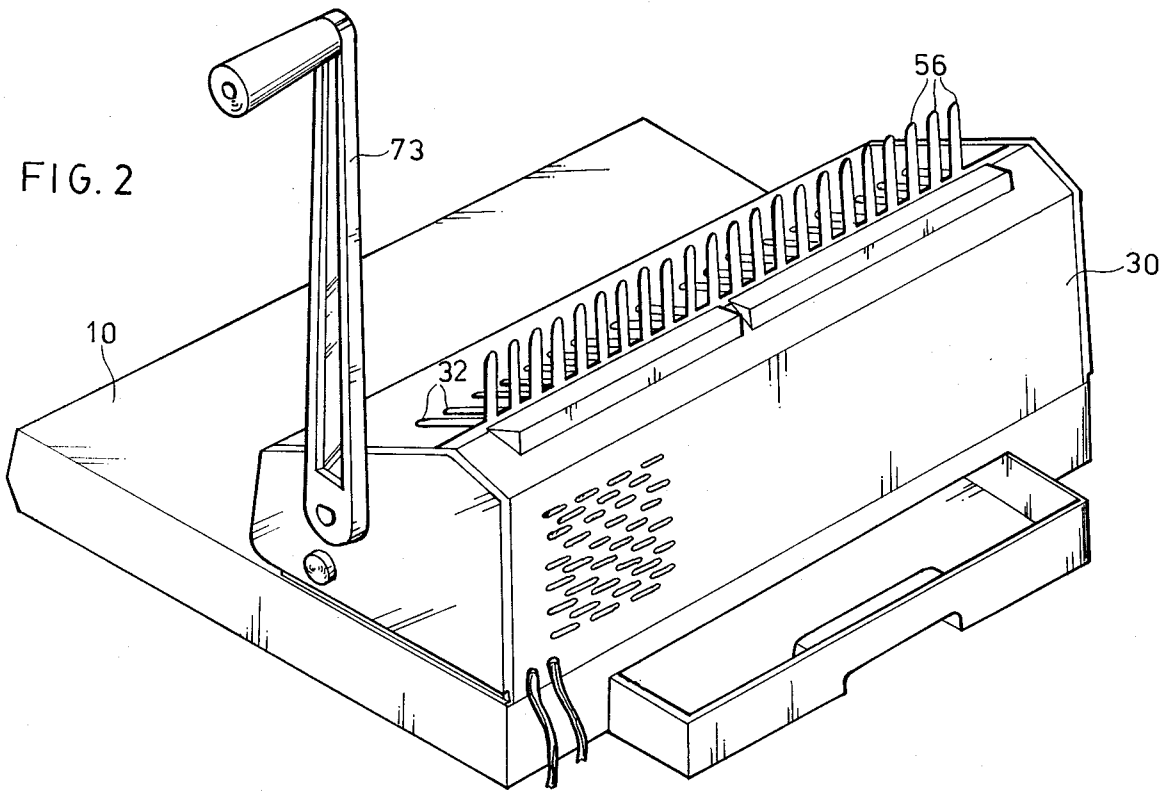
FIG. 2 is the rear perspective view of an embodiment of this invention.
Figure 3:
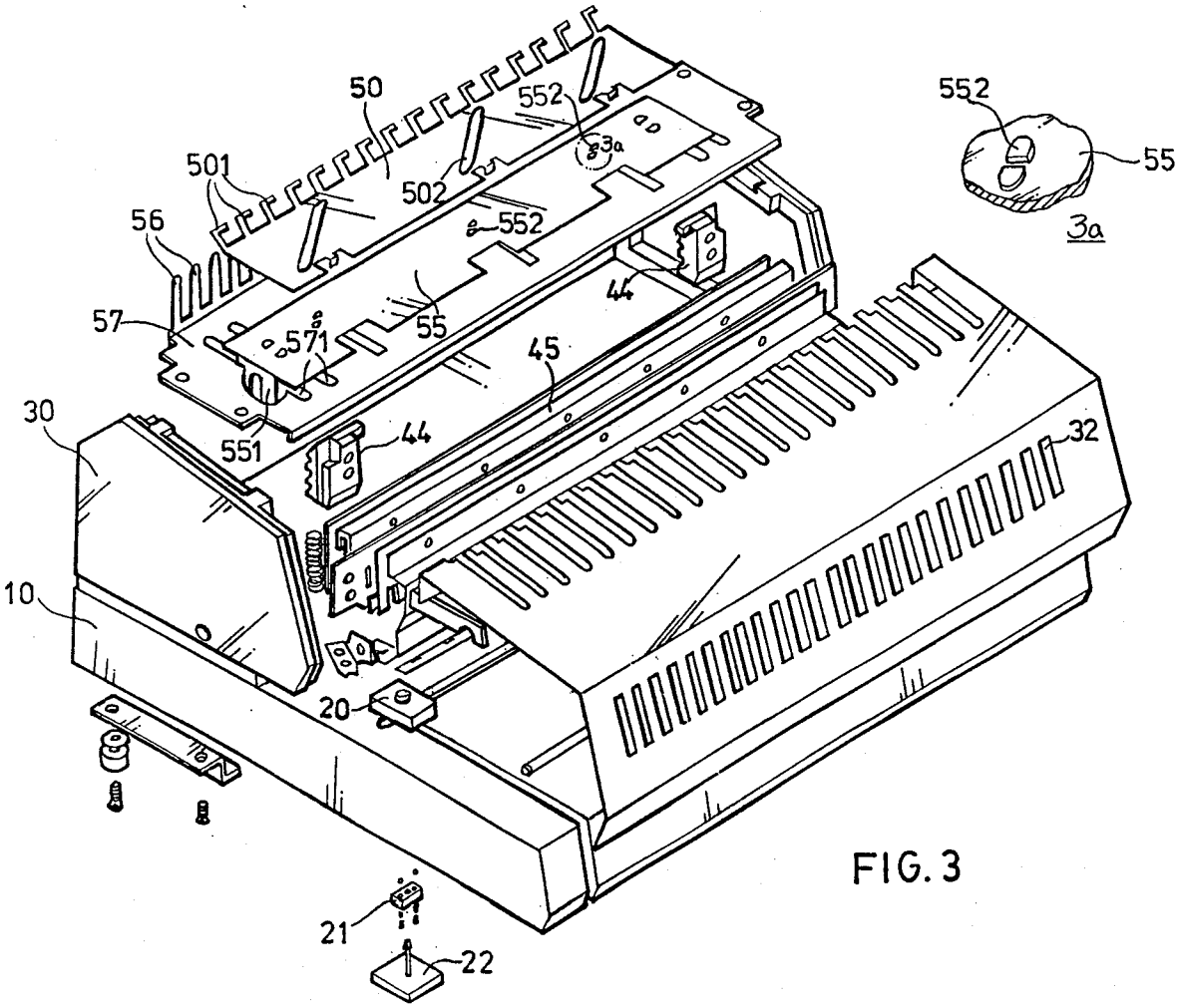
FIG. 3 is the exploded front perspective view of an embodiment of this invention.
Figure 4:
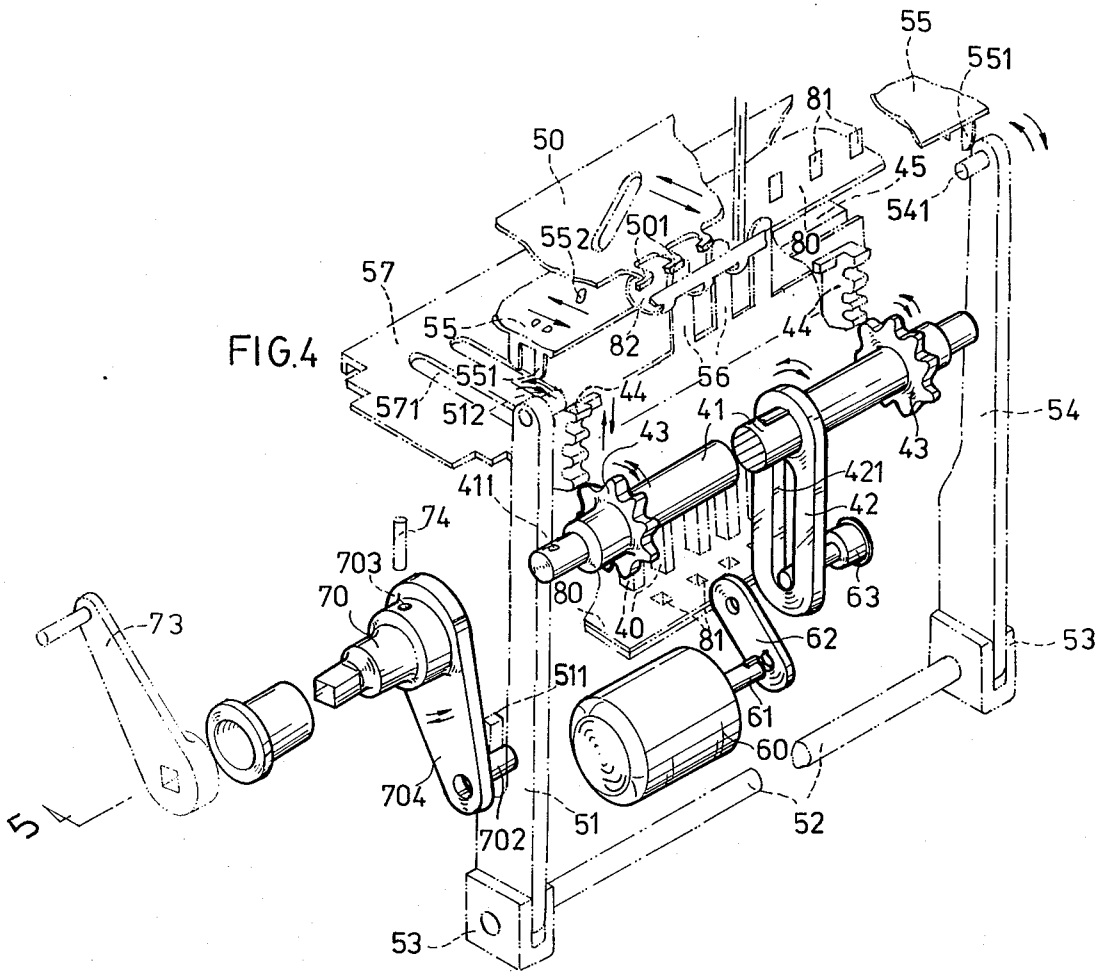
FIG. 4 is the exploded rear perspective view of an embodiment of this invention.
Figure 5:
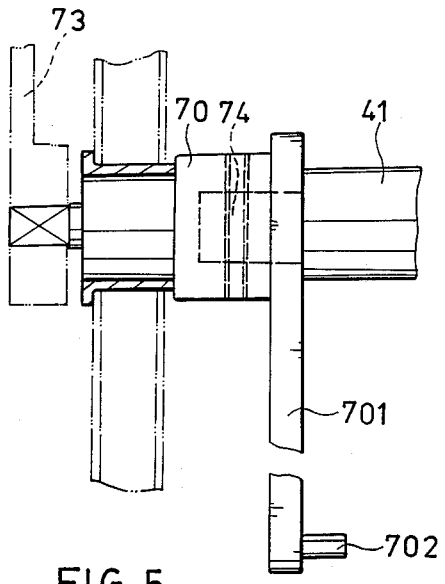
FIG. 5 is the sectional view taken along the line 5'5 of FIG. 4 to show the relation of the main shaft and the manual shaft which are coaxially pivotally placed together.

As shown in FIG. 1,2,3, and 4 the preferred embodiment of this invention consists of a base 10 whose front portion having a transverse slot 11 to let the guider block 20 slide thereon.

On the rear portion of base 10, a power member is installed, which is composed of a cover 30 with several vertical slots 31 on its front plate and several L-shaped slots 32 on its top plane to allow the hooks in a row moving along reciproatingly. There are two power members inside the cover 30; one is electric/manual punching member, the other is manual binding member.

As to the electric/manual punching member, if the electric type is applied, the preferred embodiment will include the follows:

A motor 60 mounted on base 10 with shaft parallel to main shaft 41.

A rotation plate 62 fixed on the outlet shaft 61 of motor 60 at one end.

A rod bearing 63 parallel to motor's outlet shaft 61, of which one end is fixed on the rotation plate 62, and the other end with bearing is setting inside a slot 421 of a swing plate 42 which is fixed on the main shaft 41.

A main shaft 41 is in alignment with a manual shaft 70 of which one end has a center hole to have one end of main shaft 41 pivotally set therein to come out with a "coaxial dual shaft" and enable both shafts rotating individually.

One set of aligned pin holes 703 and 411 getting through both the manual shaft 70 and main shaft 41 is on the coaxial dual shaft to have a pin 74 inserted when the punching device is driven by manpower.

One pair of pinions 43 fixed on main shaft 41 and engaged with a pair of racks 44 fixed on both sides of the punch bar 45 which is to push a row of punch blades 40 downward and pull them upward to punch holes on the papers 80 as soon as the main shaft 41 gets rotated.

When the motor 60 gets rotated, rod bearing 63 on rotation plate 62 will have the swing plate 42 swung within a certain angle; the main shaft 41 will get rotated simultaneously. The pinions 43 rotating with main shaft 41 will push the punch bar 45 downward through the racks 44 and push the punch blades 40 downward to punch row holes 81 on papers 80.

The electric punch member mentioned above can be easily revised into manual system by doing the follows: removing motor 60, rotation plate 62 and swing plate 42. Inserting a pin 74 into the aligned holes 703 and 411 on the coaxial dual shaft so as to unite the two individual shafts into one connected shaft and rotate at a wider angle.

That the handle 73 gets pushed forward will cause the manual shaft 70 and main shaft 41 rotating synchronously. The pinions 43 rotating with the main shaft 41 will push the punch bar 45 downward through the racks 44 and push the punch blades 40 downward to punch row holes 81 on papers 80.

As to the binding member, the construction and operation system are summarized as follows:

A Swing Arm 704 fixed on Manual Shaft 70.

A rod 702 fixed on the middle of Swing Arm 704, parallel to main shaft 41.

A shaft 52 pivotally setting on a couple of bracket 53 mounted on the base 10 is fixed with two vertical aligned shifting arms 51 and 54 at both ends, so that shaking of any shifting arms will make the other shifting arm shake simultaneously.

An indent on the middle of Shifting Arm 51 to hold the rod 702 of Swing Arm 704.

Two push rods 512,541 parallel to main shaft 41 are mounted on each around the upper ends of the shifting arms 51 and 54 respectively and held by a copule of indents 551 below the slide plate 55 to push the slide plate 55 sliding forward and backward.

A comb plate 57 with several longitudinal slots 571 is vertically joined with the upstanding comb 56 and setting under the slide plate 55.

A slide plate 55 on which there are several leaning lugs 552 on one side and straight lugs 551 on the opposite side, so that it can move along the straight slots 571 of the comb plate 57 below it and enable its leaning lugs 552 to set in the leaning slots 502 of the hook plate 50 and make the hook plate 50 moved at either longitudinal direction or transverse direction once it gets moved.

A hook plate 50 with several leaning slots 502 on the slide plate 55 has a row of hooks 501 to pull free ends of the binding 82.

Thus when handle 73 is pulled forward, the swing arm 704 will swing simultaneously and make the rod 702 on it to push the shifting arm 51; and the otehr shifting arm 54 will also shake synchronously due to power transmission through the shaft 52. The push rods 512 and 541 on the upper ends of shifting arm 51 and 54 will push the slide plate 55 sliding forward which will cause the hook plate 50 to move primarily at transverse direction to hook free ends of the binding 82 then move at longitudinal direction to pull it away from comb 56. And therefore, when a binding 82 is put on the comb 56, the connected end will be detained by the comb 56; the free end will be pulled by the hooks 501 of the hook plate 50 and get opened to let the punched papers 80 place on it; once the handle 73 is released, the papers 80 will be bound together by the binding.

Figure 7:
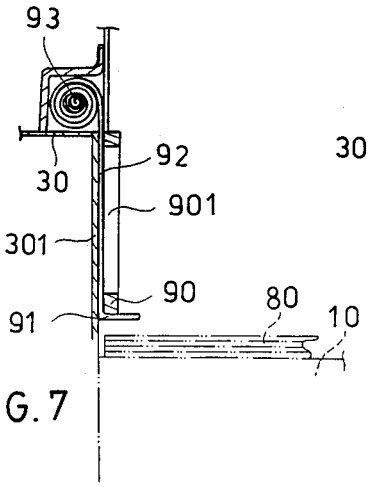
FIG. 7 is the fragmentary side view taken along the line 7—7 of FIG. 6.
Figure 6:
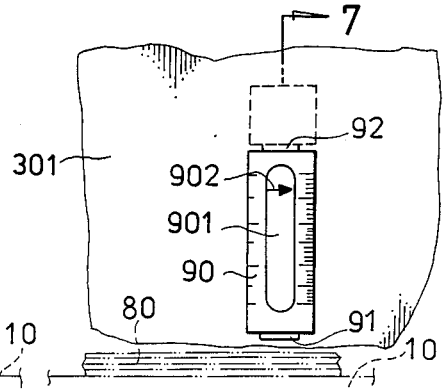
FIG. 6 is the front view of the scale panel to indicate the meeded size/no. of bindings.

As to the binding indicating member 90., shown in FIGS. 1,6,and 7, the preferred embodiment will include the follows:

A view window 901 with scales printed on its both side frames is mounted on the upright front plate 301 of cover 30.

A tape 92 with a crossing-line mark on it sliding in the view window 901 connects with a spring 93 hidden behind the front plate 301 at one end and connects with a pressing lug 91 at the other end. The pressing lug 91 pulled by the tape 92 and spring 93 is detained by the lower frame of view window 901.

When papers 80 are piled on base 10 the pressing lug 91 can be pressed downward by finger until it is stopped by finger until it is stopped by the paper 80; the needed binding size/number can be read immediately from the scale at the crossing-line mark in the view window 901.

Figure 8:
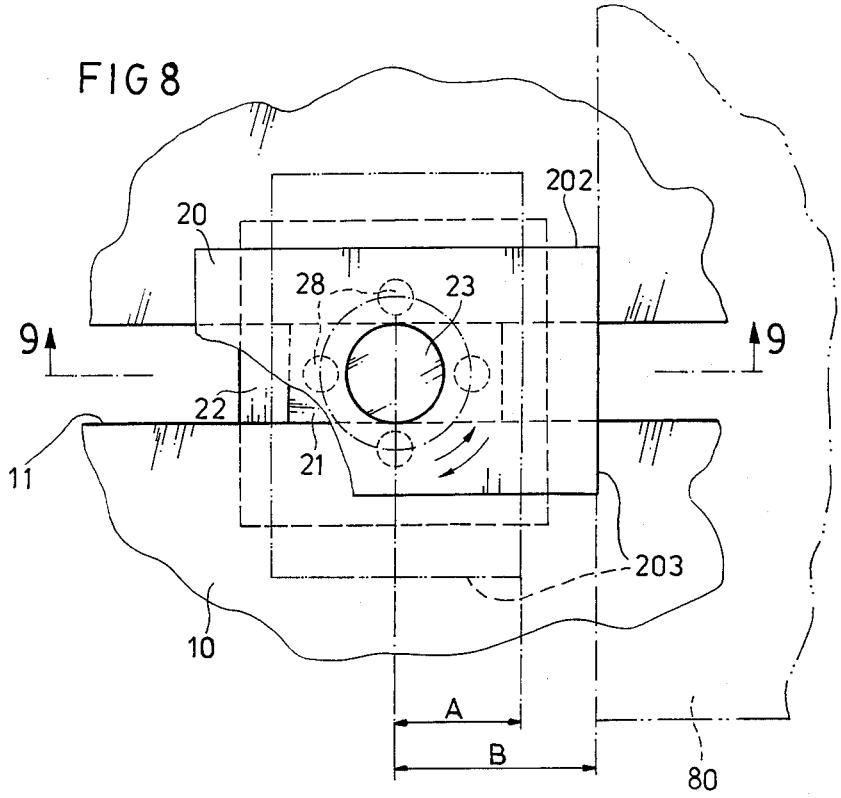
FIG. 8 is the top view of an embodiment of the margin guider.
Figure 9:
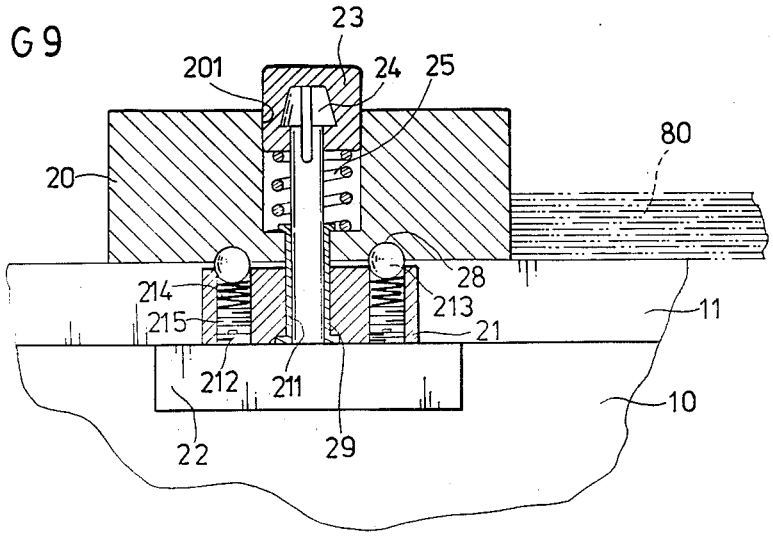
FIG. 9 is the sectional view taken along the line 9—9 of FIG. 8.
Figure 10:
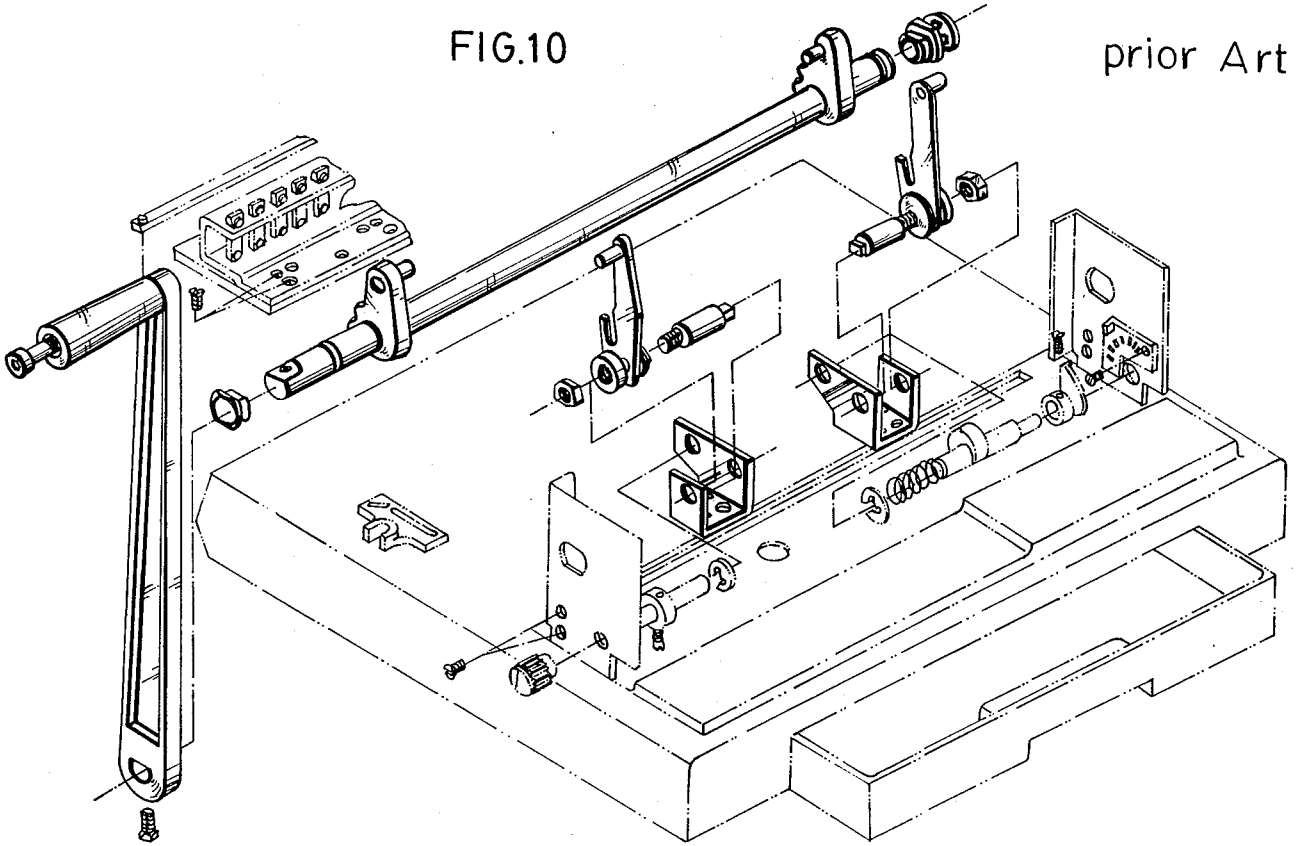
FIG.10 prior Art
FIG. 10 is the exploded rear perspective view of an embodiment of prior art.

As to the margin guiding member, shown in FIGS. 1,8, and 9, the preferred embodiment will include the follows:

A transverse slot 11 is on the base 10, on which there is a rectangular guide block 20 with a countersink 201 in the center which straddles on the transverse slot 11.

A push-rod cap 23 and a spring 25 under it are setting in the countersink 201 and in connecting with a push rod 24.

A slide block 21 which is with thickness thiner than that of base 10 and has a through center hole 211 as well as two side holes 212—both are symmetrical and parallel to the center hole 211 is under the guider block 20 with which both blocks are riveted together by an eyelet rivet 29.

In either one of the side holes 212 there is a steel ball 213 pressed by spring 214 and a stopper 215.

On the bottom side of quider block 20 there are four round cavities 28 equally allocated on a circle to let the steel balls 213 set on.

A brake piece 22 fixed with a vertical connecting rod 24 at its center is under the slide block 21.

The push-rod cap 23 and the brake piece 22 are connected by push-rod 24 to move up and down together and always pushed upward by the spring 25. And therefore , the brake piece 22 can usually touch against the bottom side of base 10 to avoid slips of the guider block 20.

People just need to have the papers 80 leant against the right side of guider block 20 after its position has been properly set.

Shown in FIG. 8, the rectangular guider block 20 can be rotated by hand to let the two steel balls 213 engaged with the round cavities 28 by turns. From a ball cavity engaging to the next engaging will need to turn 90 degrees, so the right side of guider block 20 will be changed from long side 202 to short side 203, and vice versa to easily get a margin change. The preferable distance difference between A and B is $\frac{1}{8}$ inch, as generally the margin of covers is $\frac{1}{8}$ inch longer than that of their inner pages.

The push-rod cap 23 can be pushed to make the brake piece 22 aparted from the bottom side of base 10. Thus the whole guider unit can be pushed and moved freely along the transverse slot 11 to a site being needed. As soon as the push-rod cap 23 is released the guider unit will no more be removed easily.

The devices mentioned above will make punching, driven either by electric power or manpower, and binding operations become conventient and efficient. And, any such designs to repidly indicate proper binding size/number and quickly set different margins for covers and inner pages have never been found in previous traditional devices.

Any applicatons of the above ideas, eigher revicing materials or using similar measures to obtain similar constructions, to be covered by teh claims of this invention.

We claim:

1. A compound device for punching and binding includes:

a base having a transverse slot and a transverse scale;

a power member fixed upon the rear portion of the said base;

a cover with several vertical slots on its front plate and several horizontal L-shaped slots on its top plane;

a coaxial dual shaft means composed of a main shaft and a manual shaft;

a couple of pinions fixed on the said main shaft;

a couple of racks engaged with the said pinions being fixed on the punch bar;

a comb plate providing comb and guide slots for slide plate to slide along;

a hook plate to open the bindings;

a slide plate driven by the shifting arm to push the said hook plate to and fro;

a swing arm fixed on the said manual shaft has a rod at its swing end;

a couple of shifting arms having an indent on their middles respectively to hold the said rod of swing arm and having a rod around their upper ends respectively to drive the said slide plate; and the said coaxial dual shaft means is composed of two individual shafts, which can be either joined together as a connected shaft or divided into two individual shafts—one manual shaft and one main-shaft, which can rotate separately/synchronously by removing/inserting a pin, and therefore, the device can be driven by either electric motor or by manpower while the binding operation is always operated by manpower.

2. A device as defined in claim 1, the said main shaft with one end pivotally setting inside the said manual shaft has a pin hole getting across its center to get aligned with a couple of pin holes on the said manual shaft surrounding it; thus once the said pin is inserted into the said pin holes to join both shafts together, the said main shaft will be under operations of manual handle installed on the other end of the said manual shaft.

3. A device as defined in claim 1 further including:

a motor fixed on the said base;

a rotation plate with one end fixed on the outlet shaft of said motor and the other end fixed with a rod bearing parallel to said ouetlet shaft; and a swing plate with a slot where the bearing of said rod bearing being set thereon, is fixed on the said main shaft.

4. A device as defined in claim 1 in which on the margin guider member on the said base is including:

a rectangular guider block with a center hole holding a push-rod cap and a spring and having four round cavities equally allocated on a circle of the bottom surface straddles on the said transverse slot;

a slide block under the said guider block with thickness thiner than the thickness of the said base is set in the said transverse slot, on which there are a center hole and two side holes, in either side hole there are a ball, a spring and a stopper; and a brake piece under the said slide block is connecting with the said push-rod cap with a push rod which is getting through the center hole of said slide block and the spring under the push-rod cap.

5. A device as defined in claim 1, the front plate of the said cover having:

a view window with scales printed on its both side frames;

a tape with a crossing-line mark on it sliding in the view window connects with a spring at one end and connects with a pressing lug at the other end;

thickness of the papers and size of the desired binding can be read from the said view window at the crossing-line mark on the said tape as soon as the said pressing lug is pressed downward to touch the papers laid underneath.

* * * * *